US011828217B2

(12) United States Patent
Lin

(10) Patent No.: US 11,828,217 B2
(45) Date of Patent: Nov. 28, 2023

(54) EXHAUST GAS TREATMENT ASSEMBLY FOR AN EXHAUST GAS SYSTEM OF AN INTERNAL COMBUSTION ENGINE

(71) Applicant: Purem GmbH, Neunkirchen (DE)

(72) Inventor: Shengxiao Lin, Esslingen (DE)

(73) Assignee: Purem GmbH, Neunkirchen (DE)

( * ) Notice: Subject to any disclaimer, the term of this patent is extended or adjusted under 35 U.S.C. 154(b) by 10 days.

(21) Appl. No.: 17/666,135

(22) Filed: Feb. 7, 2022

(65) Prior Publication Data

US 2022/0251994 A1 Aug. 11, 2022

(30) Foreign Application Priority Data

Feb. 8, 2021 (DE) ..... 10 2021 102 825.6

(51) Int. Cl.
*F01N 3/20* (2006.01)
*F01N 3/28* (2006.01)

(52) U.S. Cl.
CPC ..... *F01N 3/2066* (2013.01); *F01N 3/2892* (2013.01)

(58) Field of Classification Search
CPC ..... F01N 3/2066; F01N 3/2892; F01N 3/10; F01N 2610/02; B01D 53/38; B01D 53/34
USPC ..... 60/317; 423/235; 422/177, 171
See application file for complete search history.

(56) References Cited

U.S. PATENT DOCUMENTS

| | | | | |
|---|---|---|---|---|
| 7,752,839 | B2 * | 7/2010 | Hirata | F01N 3/0231 60/296 |
| 2002/0187093 | A1 | 12/2002 | Muller et al. | |
| 2003/0108457 | A1 | 6/2003 | Gault et al. | |
| 2006/0156712 | A1 | 7/2006 | Buhmann et al. | |
| 2016/0040578 | A1 * | 2/2016 | Lorenz | F01N 3/2853 60/299 |
| 2021/0301699 | A1 * | 9/2021 | Kinnaird | F01N 3/208 |

FOREIGN PATENT DOCUMENTS

| | | | | |
|---|---|---|---|---|
| DE | 600 18 794 | T2 | 3/2006 | |
| EP | 1 691 045 | A1 | 8/2006 | |
| WO | 97/01387 | A1 | 1/1997 | |
| WO | WO-2009056860 | A1 * | 5/2009 | B01D 53/90 |
| WO | 2019/144600 | A1 | 8/2019 | |
| WO | 2020/049084 | A1 | 3/2020 | |

* cited by examiner

*Primary Examiner* — Kenneth J Hansen
*Assistant Examiner* — Kelsey L Stanek
(74) *Attorney, Agent, or Firm* — Walter Ottesen, P.A.

(57) ABSTRACT

An exhaust gas treatment assembly includes a housing and an exhaust gas treatment section accommodating chamber in the housing for accommodating an exhaust gas treatment section therein so as to permit the treatment section to be removed from the housing. An exhaust gas supply duct leads to the housing and is open to the housing via a housing inlet region. A main mixing section accommodating chamber accommodates a main mixing section in such a way that the main mixing section can be removed from the housing. A first exhaust gas treatment section inlet region is open to the housing inlet region to receive exhaust gas from the exhaust gas supply duct. A first exhaust gas treatment section outlet region is open to a main mixing section exhaust gas inlet region of the main mixing section.

17 Claims, 1 Drawing Sheet

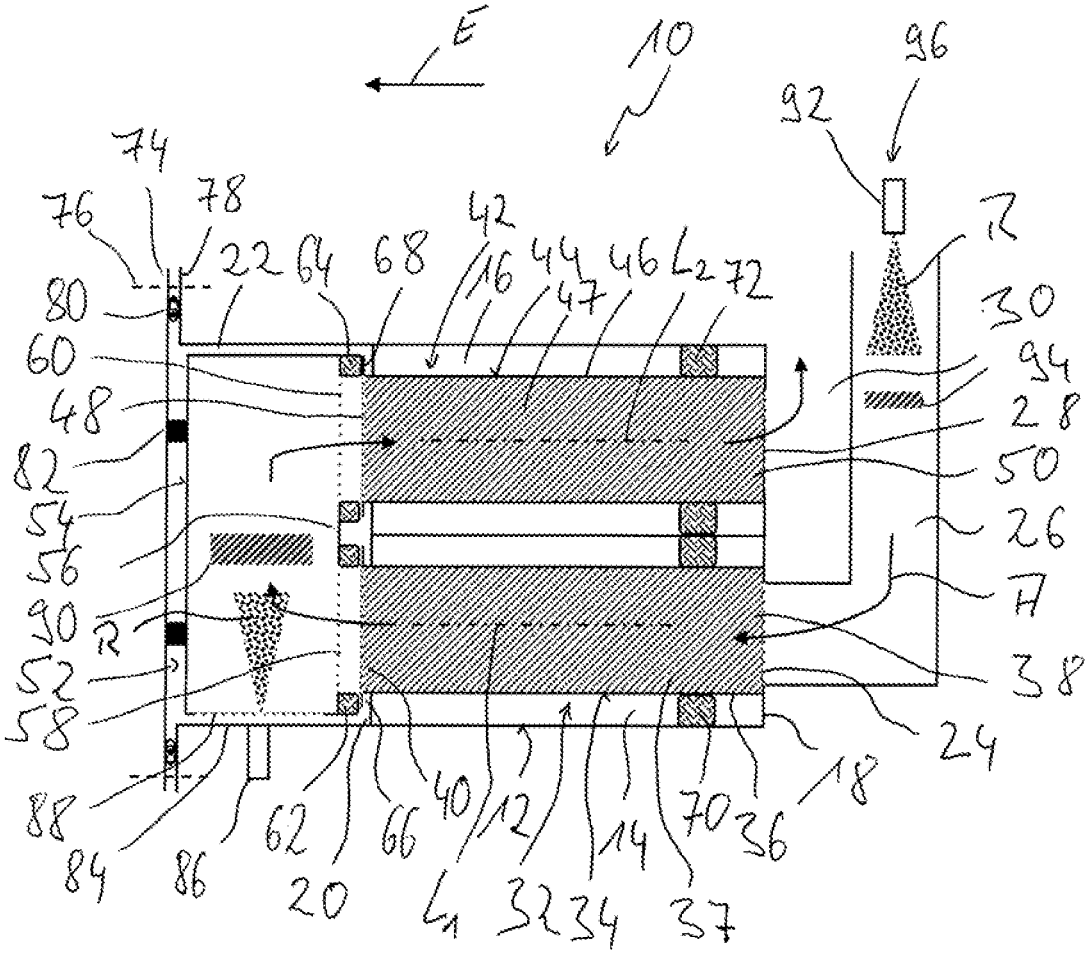
E
10
96
92
74
76
78
22
64
68
42
16
44
46
L2
72
R
30
80
60
47
94
48
28
82
50
54
26
56
H
90
R
38
52
58
24
18
88
84
86
62
20
66
40
12
L1
32
34
14
37
70
36

EXHAUST GAS TREATMENT ASSEMBLY FOR AN EXHAUST GAS SYSTEM OF AN INTERNAL COMBUSTION ENGINE

CROSS REFERENCE TO RELATED APPLICATION

This application claims priority of German patent application no. 10 2021 102 825.6, filed Feb. 8, 2021, the entire content of which is incorporated herein by reference.

TECHNICAL FIELD

The present disclosure relates to an exhaust gas treatment assembly having a housing and a plurality of exhaust gas treatment units arranged in the housing.

BACKGROUND

The use of various exhaust gas treatment units, such as catalytic converter units or particle filter units, for the purification of exhaust gas emitted by an internal combustion engine is known. These are arranged in a housing through which exhaust gas can flow, it being possible for a plurality of such exhaust gas treatment units to be provided in exhaust gas treatment sections arranged one after the other in the flow direction in order to ensure efficient exhaust gas purification in such a housing.

SUMMARY

It is an object of the present disclosure to provide an exhaust gas treatment assembly for an exhaust gas system of an internal combustion engine which, while being of simple construction, makes it possible to integrate a mixing section or an exhaust gas treatment section into a housing and also to remove the same from the housing.

The exhaust gas treatment assembly includes: a housing; at least one exhaust gas treatment section accommodating chamber in the housing for accommodating an exhaust gas treatment section in the housing in such a way that the exhaust gas treatment section can be removed from the housing; an exhaust gas supply duct leading to the housing and open to the housing via a housing inlet region in the region of a first exhaust gas treatment section accommodating chamber; a main mixing section accommodating chamber in the housing for accommodating a main mixing section in the housing in such a way that the main mixing section can be removed from the housing; and, wherein, when the first exhaust gas treatment section is accommodated in the first exhaust gas treatment section accommodating chamber and the main mixing section is accommodated in the main mixing section accommodating chamber, a first exhaust gas treatment section inlet region of the first exhaust gas treatment section is open to the housing inlet region to receive exhaust gas from the exhaust gas supply duct, and a first exhaust gas treatment section outlet region of the first exhaust gas treatment section is open to a main mixing section exhaust gas inlet region of the main mixing section.

With the construction according to the disclosure of an exhaust gas treatment assembly, the modular structure with a first exhaust gas treatment section, which is accommodated removably in the housing, and with a main mixing section makes it possible, with mixing of exhaust gas and reactant injected into the gas taking place downstream of the first exhaust gas treatment section, to provide each of these system regions in a functional state on the housing and to remove them from the housing.

To provide a flow connection between the first exhaust gas treatment section and the main mixing section, it is proposed that, when the first exhaust gas treatment section is accommodated in the first exhaust gas treatment section accommodating chamber and the main mixing section is accommodated in the main mixing section accommodating chamber, the first exhaust gas treatment section outlet region and the main mixing section exhaust gas inlet region are open to the main mixing section accommodating chamber.

To avoid flow leakages or a flow short circuit in this case, a first exhaust gas guide arrangement, which surrounds the first exhaust gas treatment section outlet region and the main mixing section exhaust gas inlet region and guides an exhaust gas flow from the first exhaust gas treatment section outlet region into the main mixing section exhaust gas inlet region, can be provided.

The first exhaust gas guide arrangement can include an annular first exhaust gas guide element, for example made of wire material, such as wire mesh or the like.

In order to be able to perform exhaust gas treatment downstream of the main mixing section, a second exhaust gas treatment section accommodating chamber for accommodating a second exhaust gas treatment section can be formed in the housing, wherein an exhaust gas discharge duct leading away from the housing is open to the housing via a housing outlet region in the region of the second exhaust gas treatment section accommodating chamber, wherein, when the second exhaust gas treatment section is accommodated in the second exhaust gas treatment section accommodating chamber and the main mixing section is accommodated in the main mixing section accommodating chamber, a second exhaust gas treatment section outlet region of the second exhaust gas treatment section is open to the housing outlet region to discharge exhaust gas into the exhaust gas discharge duct, and a second exhaust gas treatment section inlet region of the second exhaust gas treatment section is open to a main mixing section exhaust gas outlet region of the main mixing section. As in the case of the first exhaust gas treatment section accommodating chamber, the second exhaust gas treatment section accommodating chamber can thus also be open to the main mixing section accommodating chamber in order to be able to provide an exhaust gas flow connection between the exhaust gas treatment sections and the main mixing section when the exhaust gas treatment sections have been inserted.

In the case of the second exhaust gas treatment section too, a flow connection to the main mixing section can be provided by virtue of the fact that, when the second exhaust gas treatment section is accommodated in the second exhaust gas treatment section accommodating chamber and the main mixing section is accommodated in the main mixing section accommodating chamber, the second exhaust gas treatment section inlet region and the main mixing section exhaust gas outlet region are open to the main mixing section accommodating chamber.

To avoid flow leakages or a flow short circuit between the first exhaust gas treatment section outlet region and the second exhaust gas treatment section inlet region, a second exhaust gas guide arrangement, which surrounds the second exhaust gas treatment section inlet region and the main mixing section exhaust gas outlet region and guides an exhaust gas flow from the main mixing section exhaust gas outlet region into the second exhaust gas treatment section inlet region, can be provided.

The second exhaust gas guide arrangement can also include an annular second exhaust gas guide element, for example made of wire material, such as wire mesh or the like.

For stable retention of a or of each exhaust gas treatment section in the housing in a manner which is simple to implement, it is proposed that at least one, preferably each, exhaust gas treatment section is held in the exhaust gas treatment section accommodating chamber accommodating this exhaust gas treatment section by the main mixing section accommodated in the main mixing section accommodating chamber, or/and that at least one, preferably each, exhaust gas treatment section is fixed on the housing by at least one fastening member, preferably a screw bolt.

Furthermore, defined and stable positioning of the main mixing section in the housing can be achieved by virtue of the fact that a closure element, which can be released from the housing, is provided for closing the main mixing section accommodating chamber, wherein, when the main mixing section is accommodated in the main mixing section accommodating chamber, the main mixing section is held in the main mixing section accommodating chamber by the closure element.

In order to be able to achieve mixing of exhaust gas and reactant in the main mixing section, a first reactant dispensing arrangement for dispensing reactant in the direction of the main mixing section accommodating chamber can be provided on the housing in the region of the main mixing section accommodating chamber, and the main mixing section can have a main mixing section reactant inlet region for receiving reactant dispensed by the first reactant dispensing arrangement.

In order to enable even more intensive exhaust gas purification, in particular in order to reduce the nitrogen oxide content, it is further proposed that the exhaust gas supply duct be assigned a second reactant dispensing arrangement for dispensing reactant into the exhaust gas supply duct upstream with respect to the housing inlet region. Thus, a mixture of exhaust gas and reactant can be provided even before the first exhaust gas treatment section in order to be able to already provide a first stage of the reduction of the nitrogen oxide content in the first exhaust gas treatment section.

For a compact construction, a plurality of exhaust gas treatment section accommodating chambers having accommodating chamber longitudinal axes which are substantially parallel to one another can be arranged next to one another in the housing, transversely with respect to the accommodating chamber longitudinal axes. If in this case one of the exhaust gas treatment section accommodating chambers is arranged upstream of the main mixing section accommodating chamber, and a further exhaust gas treatment section accommodating chamber is arranged downstream of the main mixing section accommodating chamber, then with such an arrangement exhaust gas flows in mutually opposite directions through the two exhaust gas treatment sections, which are arranged in the exhaust gas treatment section accommodating chambers and overlap one another substantially next to one another and axially substantially completely.

The housing inlet region and the housing outlet region can be provided in a first housing wall, which delimits the first exhaust gas treatment section accommodating chamber and the second exhaust gas treatment section accommodating chamber in their axial end region remote from the main mixing section accommodating chamber.

Furthermore, to achieve a compact construction, provision can be made for the main mixing section accommodating chamber to be delimited by a second housing wall in the region of an axial end region of the exhaust gas treatment section accommodating chambers which lies close to the main mixing section accommodating chamber.

In this case, the first housing wall and the second housing wall may be arranged substantially parallel to one another.

The main mixing section, which is in principle accommodated removably in the housing, can include a main mixing section housing which can be inserted into the housing of the exhaust gas treatment assembly. For improved mixing of the exhaust gas and the reactant injected into the latter, a mixer can be arranged in the main mixing section.

At least one, preferably each, exhaust gas treatment section can include a shell and at least one exhaust gas treatment element supported in the shell, for example, via a fiber mat or the like. For a further improved exhaust gas purification function, at least one exhaust gas treatment section can include at least two exhaust gas treatment units, which follow one another in an exhaust gas flow direction.

BRIEF DESCRIPTION OF THE DRAWING

The invention will now be described with reference to the single FIGURE of the drawing (FIG. 1) which shows an exhaust gas treatment assembly in a schematic longitudinal section.

DESCRIPTION OF THE PREFERRED EMBODIMENTS

In FIG. 1, an exhaust gas treatment unit for an exhaust gas system of an internal combustion engine, for example in a vehicle, is denoted overall by 10. The exhaust gas system 10 includes a housing 12 which is essentially box-like and is constructed, for example, from sheet metal material and in which two exhaust gas treatment section accommodating chambers 14, 16 are arranged next to one another in the example illustrated. These extend substantially between a first housing wall 18 and a second housing wall 20, which is, for example, parallel to the latter, and are open in the region of the second housing wall 20 to a main mixing section accommodating chamber 22 formed in the housing 12. In this arrangement, the two exhaust gas treatment section accommodating chambers 14, 16, which are elongate in the direction of respective accommodating chamber longitudinal axes $L_1$, $L_2$, are arranged in such a way that they substantially completely overlap one another in the direction of the accommodating chamber longitudinal axes $L_1$, $L_2$.

In the region of a housing inlet region 24 formed in the first housing wall 18, an exhaust gas supply duct 26 opens into the first exhaust gas treatment section accommodating chamber 14. In the region of a housing outlet region 28 formed in the first housing wall 18 next to the housing inlet region, an exhaust gas discharge duct 30 leads away from the second exhaust gas treatment section accommodating chamber 16.

A first exhaust gas treatment section, denoted overall by 32, is accommodated in the first exhaust gas treatment section accommodating chamber 14. In the embodiment illustrated, this includes an exhaust gas treatment unit 34, which, in a tubular shell 36, can include one or more exhaust gas treatment elements 37 held on the shell 36 by a fiber mat, for example. In the region of a first exhaust gas treatment section inlet region 38, the first exhaust gas treatment section 32 or the first exhaust gas treatment unit 34 thereof is open to the housing inlet region 24, with the result that exhaust gas A flowing in via the exhaust gas supply duct 26 can enter the first exhaust gas treatment section 32 through the housing inlet region 24 and the first exhaust gas treatment section inlet region 38. In the other axial end region, the first exhaust gas treatment section 32 has a first exhaust gas treatment section outlet region 40. Via this, the exhaust gas A flowing through the first exhaust gas treatment section 32 can flow into the main mixing section accommodating chamber 22.

A second exhaust gas treatment section 42 is accommodated in the second exhaust gas treatment section accommodating chamber 16. In the example illustrated, this too includes an exhaust gas treatment unit 44 with a, for example tubular, shell 46 and at least one exhaust gas treatment element 47 held therein by a fiber mat, for example. In the region of an end of the second exhaust gas treatment section 42 facing the main mixing section accommodating chamber 22, this section is open to the main mixing section accommodating chamber 22 via a second exhaust gas treatment section inlet region 48. In the region of an end facing the first housing wall 18 or the housing outlet region 28 provided therein, the second exhaust gas treatment section 42 is open to the housing outlet region 28 and thus to the exhaust gas discharge duct 30 via a second exhaust gas treatment section outlet region 50.

A main mixing section 52 is accommodated in the main mixing section accommodating chamber 22. This includes a main mixing section housing 54, which is, for example, box-like and, like the housing 12 of the exhaust gas treatment assembly 10, is constructed, for example, with sheet-metal material. In a bottom wall 56 of the main mixing section housing 54, which is positioned opposite the second housing wall 20 of the housing 12, a main mixing section exhaust gas inlet region 58 is arranged opposite the first exhaust gas treatment section outlet region 40. Similarly, a main mixing section exhaust gas outlet region 60 is provided in the bottom wall 56 opposite the second exhaust gas treatment section inlet region 48.

In order to ensure defined flow guidance for the exhaust gas A from the first exhaust gas treatment section outlet region 40 into the main mixing section housing 54 and from the main mixing section housing 54 into the second exhaust gas treatment section inlet region 48, two annular exhaust gas guide elements 62, 64, which are constructed, for example, with wire mesh or some other flexible and exhaust gas-resistant or temperature-resistant material, are provided, which each provide an exhaust gas guide arrangement. The first exhaust gas guide element 62 surrounds the first exhaust gas treatment section outlet region 40 or the main mixing section inlet region 58 along its respective outer circumferential region and thus provides defined flow guidance for the exhaust gas A from the first exhaust gas treatment section 32 through a region of the main mixing section accommodating chamber 22 into the main mixing section housing 54. Similarly, the second exhaust gas guide element 64 surrounds the main mixing section outlet region 60 and the second exhaust gas treatment section inlet region 48 situated opposite the latter, in each case along their outer circumferential region, and thus provides for defined flow guidance out of the main mixing section housing 54 into the second exhaust gas treatment section 42. Although the two exhaust gas guide elements 62, 64 do not necessarily have to provide a completely gas-tight seal, they prevent a flow short circuit directly from the first exhaust gas treatment section 32, through the main mixing section accommodating chamber 22, to the second exhaust gas treatment section 42.

The two exhaust gas guide elements 62, 64 can be supported on the bottom wall 56 of the main mixing section housing 54, on the one hand, and on a respective flange-type holding region 66, 68 of the exhaust gas treatment sections 32 and 42, respectively, which projects radially outward from the shell 36 and 46, respectively, on the other hand, and thus, when the main mixing section 52 is accommodated in the main mixing section accommodating chamber 22, can hold the two exhaust gas treatment sections 32, 42 or exhaust gas treatment units 34, 44 in a defined position in the respective exhaust gas treatment section accommodating chamber 14, 16. In order in this case to be able to support the exhaust gas treatment sections 32, 34 in a defined manner in the radial direction in the region of the other axial end of the latter, it is possible to provide radial support units 70, 72, which are respectively assigned to the sections. These can surround the respective shell 36, 46 on its outside and can include annular radial support elements, made, for example of wire mesh or some other flexible material, which are supported on the walls surrounding the respective exhaust gas treatment section accommodating chamber 14 or 16. Furthermore, the radial support units 70, 72 can include sealing elements which, in this axial end region of the exhaust gas treatment sections 32, 42, can provide tight closure of the latter with respect to the walls of the housing 12 which surround the exhaust gas treatment section accommodating chambers 14, 16.

As an alternative or in addition to the holding function, provided by the main mixing section 52, for the two exhaust gas treatment sections 32, 42, these can be releasably fixed to the second housing wall 20, for example in the region of their respective holding flanges 66, 68, by fastening members, for example screw bolts.

With a closure element 74 of cover-type configuration, the main mixing section accommodating chamber 22 can be closed off in an exhaust-gas-tight manner on its side lying opposite the second housing wall 20 by fastening members 76, for example threaded bolts. For this purpose, a sealing element 80 can be arranged between a fastening flange 78 and the closure element 74. Furthermore, it is possible to provide holding members 82 which act between the closure element 74 and the main mixing section housing 54 and via which the main mixing section housing 54 is pressed against the exhaust gas guide elements 62, 64. In order in this case to achieve defined positioning of the main mixing section housing 54 in the main mixing section accommodating chamber 22 in the direction of the accommodating chamber longitudinal axes L1, L2, the holding members 82, which are provided on the closure element 74, for example, can be of substantially rigid configuration, that is, substantially non-deformable under the forces which occur.

In association with the main mixing section 52, a first reactant dispensing arrangement 86, also referred to in general as an injector, is provided on a circumferential wall 84 of the housing 12 in the region of the main mixing section accommodating chamber 22. A reactant R in the form of a spray cone can be injected into the main mixing section accommodating chamber 22 by the first reactant dispensing arrangement 86. When the main mixing section 52 is accommodated in the main mixing section accommodating chamber 22, the first reactant dispensing arrangement 86 is opposite a main mixing section reactant inlet region 88, through which reactant can be injected into the main mixing section housing 54 and thus into the exhaust gas flow flowing through the latter. Like all the other inlet regions and outlet regions already mentioned above, the main mixing section reactant injection region 88 can include one or more openings. In order to promote the mixing of the exhaust gas A and the reactant R, a mixer 90 can be arranged in the main mixing section housing 54, the mixer ensuring efficient mixing of the reactant R and the exhaust gas A by virtue of the turbulence generated thereby, on the one hand, and by virtue of the reactant evaporation caused at its surface, on the other hand.

A second reactant dispensing arrangement 92, which can inject reactant R in the form of a spray cone into the exhaust gas supply duct 26 and thus into the exhaust gas A flowing therein, can likewise be assigned to the exhaust gas supply duct 26. Here too, a mixer 94 can be provided in order to promote the mixing of the reactant R and the exhaust gas A in an efficient manner. The second reactant dispensing arrangement 92, in conjunction with the mixer 94 and the exhaust gas supply duct 26, thus provides a premixing section 96 in which a mixture of exhaust gas A and reactant R absorbed therein, for example a urea/water solution, can be produced even before entry into the housing 12 or into the first exhaust gas treatment section 32.

If such a premixing section 96 is provided, the first exhaust gas treatment section 32 or the exhaust gas treatment unit 34 thereof can include a preliminary SCR catalytic converter, in which a reduction in the nitrogen oxide content of the exhaust gas A can already be achieved. In addition, the first exhaust gas treatment section 32 can include an oxidation catalytic converter, in particular a diesel oxidation catalytic converter, or/and a particle filter, in particular a diesel particle filter. If no premixing section 96 is provided in association with the exhaust gas supply duct 26, that is, if no reactant is injected into the exhaust gas flow upstream of the first exhaust gas treatment section 32, the first exhaust gas treatment section 32 does not include a preliminary SCR catalytic converter. In this case, the main mixing section 52 forms the only mixing section of the exhaust gas treatment arrangement 10.

The second exhaust gas treatment section 42 includes a main SCR catalytic converter, in which a further reduction of the nitrogen oxide content takes place, involving conversion of the reactant R injected in the main mixing section 52. Furthermore, the second exhaust gas treatment section 42 can include an ammonia blocking catalytic converter in order to prevent ammonia that has not been converted in the second exhaust gas treatment section 42 from escaping from the housing 12.

Each of the exhaust gas treatment sections 32, 42 can be constructed with a single exhaust gas treatment unit 34 or 44, it being possible for a plurality of exhaust gas treatment elements, which, for example, assume different functions, for example, the function of the preliminary SCR catalytic converter or of the main SCR catalytic converter or of an oxidation catalytic converter or of a particle filter, to be accommodated in a single exhaust gas treatment unit 34 or 44. Each such exhaust gas treatment element can be constructed with a body which is, for example, monolithic and through which exhaust gas can flow and which can be constructed or/and coated with catalytically active material. In an alternative embodiment, the exhaust gas treatment sections 32 or/and 42 can each be constructed with a plurality of exhaust gas treatment units which are constructed separately from one another and each have a shell and at least one exhaust gas treatment element which is accommodated in the shell. These exhaust gas treatment units formed separately from one another can be inserted successively into the exhaust gas treatment section accommodating chambers 14 and 16 in the direction of the respective accommodating chamber longitudinal axis $L_1$ and $L_2$, with the result that the exhaust gas treatment units arranged successively in the axial direction hold one another in a defined manner in the direction of the respective accommodating chamber longitudinal axis $L_1$ and $L_2$, and the exhaust gas treatment unit which provides the first exhaust gas treatment section outlet region 40 and the exhaust gas treatment unit which provides the second exhaust gas treatment section inlet region 48 are fixed with respect to the housing 12 in the manner described above by the main mixing section 52 or the main mixing section housing 54 or/and one or more fastening members.

With the construction of an exhaust gas treatment assembly 10 according to the disclosure, the modular structure makes it a simple matter to insert each of the functional groups, that is, the two exhaust gas treatment sections 32, 42 or the exhaust gas treatment units 34, 44 thereof, as well as the main mixing section 52 providing a throughflow volume or a deflection volume for the exhaust gas flow, into the housing 12 and to remove them from the housing 12, for example to carry out maintenance work or repair work or to replace them with cleaned or new sections. For this purpose, all that is required is to release the closure element 74 from the housing 12, as a result of which access to the main mixing section 52 and, after the latter has been removed, to the exhaust gas treatment sections 32 and 42 is obtained. By virtue of the possibility of also being able, in particular, to remove the main mixing section 52 from the housing 12, it can easily be cleaned of urea deposits that form therein outside the housing 12 or, if this is not possible on account of excessive deposits, it can be replaced with a new one.

During operation, the exhaust gas A flows through the two exhaust gas treatment sections 32, 42 in mutually opposite directions. The flow deflection takes place in the region of the main mixing section 52. To remove the two exhaust gas treatment sections 32, 42 from the housing or the respective exhaust gas treatment section accommodating chambers 14, 16, both exhaust gas treatment sections 32, 42 are pulled out of the housing 12 in a direction E which is substantially parallel to the accommodating chamber longitudinal axes $L_1$, $L_2$, or are inserted into the housing 12 again by movement in the opposite direction.

It is understood that the foregoing description is that of the preferred embodiments of the invention and that various changes and modifications may be made thereto without departing from the spirit and scope of the invention as defined in the appended claims.

What is claimed is:

1. An exhaust gas treatment assembly for an exhaust gas system of an internal combustion engine, the exhaust gas treatment assembly comprising:

a housing;

a first exhaust gas treatment module;

a first exhaust gas treatment module accommodating chamber arranged in said housing for accommodating said first exhaust gas treatment module in said housing so as to permit removal of said first exhaust gas treatment module from said housing;

said housing having a housing inlet region at or near said first exhaust gas treatment module accommodating chamber;

an exhaust gas supply duct leading to said housing and open to said housing via said housing inlet region;

a main mixing module having a main mixing module housing;

said main mixing module housing having a main mixing module reactant inlet region for receiving reactant (R) dispensed by a first reactant dispensing arrangement;

said housing having a main mixing module accommodating chamber for accommodating said main mixing module housing of said main mixing module therein so as to permit said main mixing module housing of said main mixing module to be removable from said housing;

said first reactant dispensing arrangement being provided on said housing in a region of said main mixing module accommodating chamber for dispensing said reactant (R) in a direction to said main mixing module accommodating chamber;

said first exhaust gas treatment module being accommodated in said first exhaust gas treatment module accommodating chamber;

said main mixing module housing of said main mixing module being accommodated in said main mixing module accommodating chamber;

said first exhaust gas treatment module having a first exhaust gas treatment module inlet region open to said housing inlet region to receive exhaust gas (A) from said exhaust gas supply duct;

said main mixing module housing of said main mixing module having a main mixing module exhaust gas inlet region;

said first exhaust gas treatment module having a first exhaust gas treatment module outlet region open to said main mixing module exhaust gas inlet region; and, said first exhaust gas treatment module outlet region and said main mixing module exhaust gas inlet region being open to said main mixing module accommodating chamber.

2. The exhaust gas treatment assembly of claim 1, further comprising a first exhaust gas guide arrangement surrounding said first exhaust gas treatment module outlet region and said main mixing module exhaust gas inlet region; and, said first exhaust gas guide arrangement being configured to guide an exhaust gas flow from said first exhaust gas treatment module outlet region into said main mixing module exhaust gas inlet region.

3. The exhaust gas treatment assembly of claim 2, wherein said first exhaust gas guide arrangement comprises an annular first exhaust gas guide element.

4. The exhaust gas treatment assembly of claim 1, further comprising:

a second exhaust gas treatment module;

a second exhaust gas treatment module accommodating chamber accommodating said second exhaust gas treatment module therein and being formed in said housing;

said housing having an outlet region at or near said second exhaust gas treatment accommodating chamber;

an exhaust gas discharge duct leading away from said housing and being open to said housing via said outlet region of said housing;

said second exhaust gas treatment module having a second exhaust gas treatment module outlet region open to said outlet region of said housing for discharging exhaust gas (A) into said exhaust gas discharge duct;

said said main mixing module housing of said main mixing module having a main mixing module exhaust gas outlet region; and, said second exhaust gas treatment module having a second exhaust gas treatment module inlet region open to said main mixing module exhaust gas outlet region.

5. The exhaust gas treatment assembly of claim 4, wherein said second exhaust gas treatment module inlet region and said main mixing module exhaust gas outlet region are open to said main mixing module accommodating chamber when said second exhaust gas treatment module is accommodated in said second exhaust gas treatment module accommodating chamber and said main mixing module is accommodated in said mixing module accommodating chamber.

6. The exhaust gas treatment assembly of claim 5, further comprising a second exhaust gas guide arrangement surrounding said second exhaust gas treatment module inlet region and said main mixing module exhaust gas outlet region; and, said second exhaust gas guide arrangement being configured to guide an exhaust gas flow from said main mixing module exhaust gas outlet region into said second exhaust gas treatment module inlet region.

7. The exhaust gas treatment assembly of claim 6, wherein said second exhaust gas guide arrangement comprises an annular second exhaust gas guide element.

8. The exhaust gas treatment assembly of claim 1, wherein at least one of the following applies:

a) said first exhaust gas treatment module is held in said exhaust gas treatment module accommodating chamber by said main mixing module housing of said main mixing module accommodated in said main mixing module accommodating chamber; and, b) said first exhaust gas treatment module is fixed on said housing by at least one fastening member.

9. The exhaust gas treatment assembly of claim 8, wherein said at least one fastening member is a threaded bolt.

10. The exhaust gas treatment assembly of claim 1, further comprising a cover configured to be released from said housing and to close said main mixing module accommodating chamber; and, said cover being further configured to hold said main mixing module in said main mixing module accommodating chamber when said main mixing module is accommodated in said main mixing module accommodating chamber.

11. The exhaust gas treatment assembly of claim 1, wherein said reactant (R) is a first reactant; and, said exhaust gas treatment assembly further comprises a second reactant dispensing arrangement assigned to said exhaust gas supply duct and being configured to dispense a second reactant (R) into said exhaust gas supply duct upstream with respect to said housing inlet region.

12. The exhaust gas treatment assembly of claim 1, further comprising a second exhaust gas treatment module accommodating chamber defining a longitudinal axis (L2); said first exhaust gas treatment module accommodating chamber defining a longitudinal axis (L1); said longitudinal axes (L1, L2) being parallel to one another and being arranged next to one another in said housing.

13. The exhaust gas treatment assembly of claim 12, wherein said housing has an outlet region at or near said second exhaust gas treatment module accommodating chamber and said housing further has a first housing wall delimiting said first exhaust gas treatment module accommodating chamber and said second exhaust gas treatment module accommodating chamber in an axial end region of said first exhaust gas treatment module accommodating chamber and said second exhaust gas treatment module accommodating chamber remote from said main mixing module accommodating chamber; and, said housing inlet region and said outlet region of said housing are provided in said first housing wall.

14. The exhaust gas treatment assembly of claim 13, wherein said first and second exhaust gas treatment module accommodating chambers have respective axial end regions lying close to said main mixing module accommodating chamber; and, said housing has a second housing wall delimiting said main mixing module accommodating chamber and being disposed close to said region of said respective axial end regions of said exhaust gas treatment module accommodating chambers.

15. The exhaust gas treatment assembly of claim 14, wherein said first and second housing walls are arranged so as to be parallel to one another.

16. The exhaust gas treatment assembly of claim 1, wherein said main mixing module includes a mixer arranged in said main mixing module.

17. The exhaust gas treatment assembly of claim 4, wherein said housing further has a first housing wall delimiting said first exhaust gas treatment module accommodating chamber and said second exhaust gas treatment module accommodating chamber in respective axial end regions remote from said main mixing module accommodating chamber; and, said housing inlet region and said outlet region of said housing are provided in said first housing wall.

* * * * *